US006499150B1

(12) United States Patent
Thompson

(10) Patent No.: US 6,499,150 B1
(45) Date of Patent: Dec. 31, 2002

(54) FOR A TOILET FOR AUTOMATICALLY EXHAUSTING ODIOUS AIR THEREFROM

(76) Inventor: Nat Thompson, 3344 102nd St., Corona, NY (US) 11368

( * ) Notice: Subject to any disclaimer, the term of this patent is extended or adjusted under 35 U.S.C. 154(b) by 121 days.

(21) Appl. No.: 09/879,655

(22) Filed: Jun. 12, 2001

(51) Int. Cl.[7] ..... E03D 9/052
(52) U.S. Cl. ..... 4/213; 4/216
(58) Field of Search ..... 4/213, 216, 348, 4/350, 351

(56) References Cited

U.S. PATENT DOCUMENTS 1,931,052 A * 10/1933 Baither ..... 4/213
1,937,305 A * 11/1933 Baither ..... 4/213 X
1,955,579 A * 4/1934 De Malaussene ..... 4/213
1,972,774 A * 9/1934 Hartwell ..... 4/213
2,724,840 A * 11/1955 Scott et al. ..... 4/216
4,222,129 A * 9/1980 Baker ..... 4/213

* cited by examiner

*Primary Examiner*—Robert M. Fetsuga

(57) ABSTRACT

A toilet that exhausts odious air therefrom. The toilet includes a bowl, a main trap, a housing, a secondary trap, and a fan. The bowl has a rim and contains a chamber that communicates with the rim and receives human waste that produces the odious air. The main trap is contained in the bowl and communicates the chamber with a waste so as to provide a passageway from the chamber to the waste for the human waste. The housing is contained in the bowl and communicates the chamber with the waste so as to provide a passageway from the chamber to the waste for the odious air. The secondary trap is contained in the bowl and communicates the housing with the waste so as to provide a passageway from the housing to the waste for the odious air. The fan is contained in the housing and activates when a user sits on the bowl, and when activated, moves the odious air from the chamber, through the housing, through the secondary trap, and into the waste.

7 Claims, 1 Drawing Sheet

FOR A TOILET FOR AUTOMATICALLY EXHAUSTING ODIOUS AIR THEREFROM

BACKGROUND OF THE INVENTION

1. Field of the Invention

The present invention relates to a toilet. More particularly, the present invention relates to a toilet for exhausting odious air therefrom.

2. Description of the Prior Art

Numerous innovations for toilets have been provided in the prior art that will be described. Even though these innovations may be suitable for the specific individual purposes to which they address, however, they differ from the present invention.

FOR EXAMPLE, U.S. Pat. No. 4,103,370 to Arnold teaches a water closet that has an intake manifold interposed between the seat and the top periphery of the bowl. A suction blower is arranged to draw gases from the manifold, and deliver them to the sewer connection beyond the water trap. The components, including the ventilation connection, are within, or secured to, the bowl and tank structure.

ANOTHER EXAMPLE, U.S. Pat. No. 5,054,131 to Sim teaches a toilet assembly which includes a toilet stool having a ventilation conduit disposed adjacent to the back wall portion of the toilet stool for ventilating objectionable odor from a toilet bowl, the ventilation conduit extending annularly around a siphon conduit at the point where they communicate with a sewer discharge line, a fan member disposed in the lower portion of the ventilation conduit, a toilet holding tank having a motion sensor disposed on the front exterior of the toilet holding tank and free of interference from the opening and closing of a toilet seat cover, and an U-shaped gas exhaust duct disposed in the toilet holding tank and connected to the ventilation conduit for allowing exhaust gas to flow from a flush ring to the ventilation conduit, whereby upon opening the toilet seat cover, while the user sits on the seat ring, the motion sensor is actuated to operate the fan member and the objectionable odor is ventilated, and in turn when the user stands and flushes the toilet assembly, the motion sensor is deactivated and simultaneously the flush water discharges the waste product and associated objectionable odor directly to the sewer discharge line.

STILL ANOTHER EXAMPLE, U.S. Pat. No. 5,079,782 to Sim teaches a toilet assembly which includes a toilet stool having a ventilation conduit disposed adjacent to the back wall portion of the toilet stool for ventilating objectionable odor from a toilet bowl, the ventilation conduit extending annularly around a siphon conduit at the point where they communicate with a sewer discharge line, a fan member disposed in the lower portion of the ventilation conduit, a toilet holding tank having a motion sensor disposed on the front exterior of the toilet holding tank and free of interference from the opening and closing of a toilet seat cover, a gas exhaust duct connected to the ventilation conduit and having a raised portion disposed at the interior surface thereof for allowing exhaust gas to flow from a flush ring to the ventilation conduit and preventing the flush water from flowing into the ventilation conduit, whereby opening the toilet seat cover while the user sits on the seat ring, the motion sensor actuates the fan member allowing the objectionable odor to be ventilated and in turn, when the user stands up and flushes the toilet assembly, the motion sensor is deactivated and the flush water simultaneously discharges the waste products and associated objectionable odor directly to the sewer discharge line.

YET STILL ANOTHER EXAMPLE, U.S. Pat. No. 6,073,275 to Klopocinski teaches a multifunction toilet with a conventional flushing system and auxiliary components which include an odor exhaust system which withdraws gases from the toilet bowl and delivers them to the sewage drain downstream of the toilet water trap. Other auxiliary components include a motor driven retractable nozzle pipe which provides a personal warm water spray rinse and a dryer which supplies warm drying air. The auxiliary components are operated under a switch control system which assures proper sequencing and prevents use unless the user is seated on the toilet seat.

It is apparent that numerous innovations for toilets have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a toilet for exhausting odious air therefrom that avoids the disadvantages of the prior art.

ANOTHER OBJECT of the present invention is to provide a toilet for exhausting odious air therefrom that is simple to use.

BRIEFLY STATED, STILL ANOTHER OBJECT of the present invention is to provide a toilet that exhausts odious air therefrom. The toilet includes a bowl, a main trap, a housing, a secondary trap, and a fan. The bowl has a rim and contains a chamber that communicates with the rim and receives human waste that produces the odious air. The main trap is contained in the bowl and communicates the chamber with a waste so as to provide a passageway from the chamber to the waste for the human waste. The housing is contained in the bowl and communicates the chamber with the waste so as to provide a passageway from the chamber to the waste for the odious air. The secondary trap is contained in the bowl and communicates the housing with the waste so as to provide a passageway from the housing to the waste for the odious air. The fan is contained in the housing and activates when a user sits on the bowl, and when activated, moves the odious air from the chamber, through the housing, through the secondary trap and into the waste.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

Figure 1:
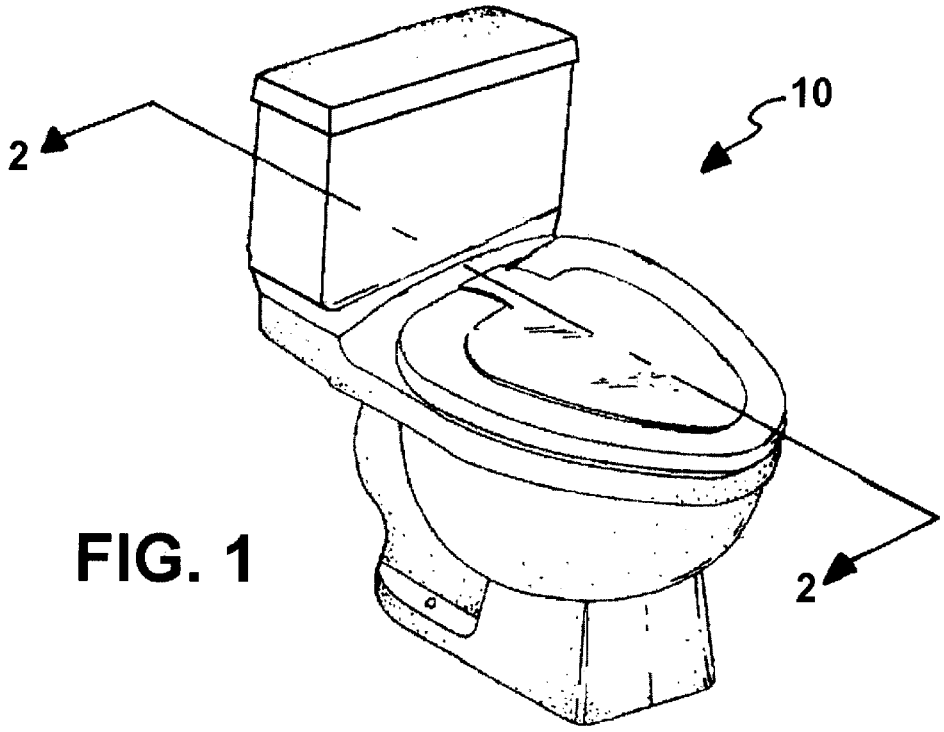
FIG. 1 is a diagrammatic perspective view of the present invention.

LIST OF REFERENCE NUMERALS UTILIZED IN THE DRAWING toilet of present invention for exhausting odious air (not shown) therefrom

12 bowl
14 rim of bowl 12
16 chamber contained in bowl 12 for receiving human waste (not shown) that produces odious air (not shown)
18 main trap for communicating chamber 16 with waste 20 so as to provide passageway from chamber 16 to waste 20 for human waste (not shown)
20 waste
22 housing for providing passageway from chamber 16 to waste 20 for odious air (not shown)
24 secondary trap for providing passageway from housing 22 to waste 20 for odious air (not shown)
26 fan for activating when user (not shown) sits on bowl 12, and when activated, moves odious air (not shown) from chamber 16, through housing 22, through secondary trap 24, and into waste 20
28 pressure sensitive switch for being activated when user (not shown) sits on bowl 12, and when activated, causes fan 26 to activate
30 timer
32 water tank for supplying water (not shown) to bowl 12
34 water supply line for allowing secondary trap 24 to fill with water (not shown)
36 electric valve for allowing selective flow of water (not shown) through water supply line 34, and allows the water (not shown) through the water supply line 34 and into, and fill, the secondary trap 24 only when the fan 26 deactivates
38 spring biased flap for preventing water (not shown) filling secondary trap 24 from backing up into housing 22, by virtue of only being opened when fan 26 activates by virtue of being opened by odious air (not shown) flowing through secondary trap 24, and fan only being activated when electric valve 36 prevents water from entering into secondary trap 24
40 gooseneck for providing a passageway for odious air (not shown) in chamber 16 to enter housing 22
42 urine shield for preventing urine (not shown) being deposited in chamber 16 from entering into gooseneck 40

DETAILED DESCRIPTION OF THE PREFERRED EMBODIMENT

Referring now to the figures, in which like numerals indicate like parts, and particularly to FIG. 1, which is a diagrammatic perspective view of the present invention, the toilet of the present invention is shown generally at 10 for exhausting odious air (not shown) therefrom.

Figure 2:
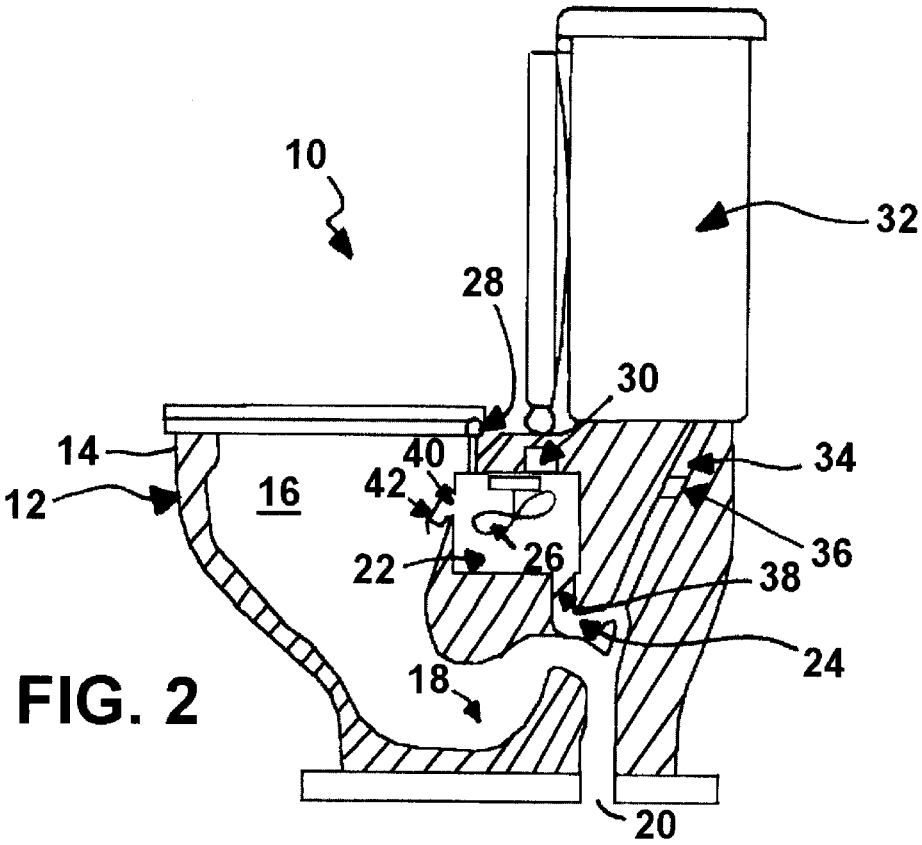
FIG. 2 is an enlarged diagrammatic cross sectional view taken on LINE 2—2 in FIG. 1.

The configuration of the toilet 10 can best be seen in FIG. 2, which is an enlarged diagrammatic cross sectional view taken on LINE 2—2 in FIG. 1, and as such, will be discussed with reference thereto.

The toilet 10 comprises a bowl 12 that has a rim 14 and contains a chamber 16 that communicates with the rim 14 and is for receiving human waste (not shown) that produces the odious air (not shown).

The toilet 10 further comprises a main trap 18 that is contained in the bowl 12 and is for communicating the chamber 16 with a waste 20 so as to provide a passageway from the chamber 16 to the waste 20 for the human waste (not shown).

the toilet 10 further comprises a housing 22 that is contained in the bowl 12 and is for communicating the chamber 16 with the waste 20 so as to provide a passageway from the chamber 16 to the waste 20 for the odious air (not shown).

The toilet 10 further comprises a secondary trap 24 that is contained in the bowl 12 and is for communicating the housing 22 with the waste 20 so as to provide a passageway from the housing 22 to the waste 20 for the odious air (not shown).

The toilet 10 further comprises a fan 26 that is contained in the housing 22 and is for activating when a user (not shown) sits on the bowl 12, and when activated, moves the odious air (not shown) from the chamber 16, through the housing 22, through the secondary trap 24, and into the waste 20.

The toilet 10 further comprises a pressure sensitive switch 28 that extends operatively upwardly from the rim 14 of the bowl 12, and is for being activated when the user (not shown) sits on the bowl 12, and when activated, causes the fan 26 to activate.

The toilet 10 further comprises a timer 30 that is contained in the bowl 12, electrically communicates with the fan 26, and allows the fan 26 to operate for a predetermined period of time after the pressure sensitive switch 28 has been released.

The toilet 10 further comprises a water tank 32 that fluidly communicates with the bowl 12 and is for supplying water (not shown) thereto.

The toilet 10 further comprises a water supply line 34 that is contained in the bowl 12, fluidly communicates the water tank 32 with the secondary trap 24, and is for allowing the secondary trap 24 to fill with the water (not shown).

The toilet 10 further comprises an electric valve 36 that is in electrical communication with the fan 26, is operatively connected in the water supply line 34, and is for allowing selective flow of the water (not shown) through the water supply line 34, and allows the water (not shown) through the water supply line 34 and into, and fill, the secondary trap 24 only when the fan 26 deactivates.

The toilet 10 further comprises a spring biased flap 38 that is disposed between the housing 22 and the secondary trap 24, normally closes fluid access to the housing 22 from the secondary trap 24, and is for preventing the water (not shown) filling the secondary trap 24 from backing up into the housing 22 by virtue of only being opened when the fan 26 activates by virtue of being opened by the odious air (not shown) flowing through the secondary trap 24 and the fan only being activated when the electric valve 36 prevents the water from entering into the secondary trap 24.

The toilet 10 further comprises a gooseneck 40 that is contained in the bowl 12, communicates the chamber 16 with the housing 22, and is for providing a passageway for the odious air (not shown) in the chamber 16 to enter the housing 22.

The toilet 10 further comprises a urine shield 42 that extends over the gooseneck 40 and into the chamber 16 and is for preventing urine (not shown) being deposited in the chamber 16 from entering into the gooseneck 40.

It will be understood that each of the elements described above, or two or more together, may also find a useful application in other types of constructions differing from the types described above.

While the invention has been illustrated and described as embodied in a toilet for exhausting odious air therefrom, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A toilet for exhausting odious air therefrom, comprising:

a) a bowl;

b) a main trap;

c) a housing;

d) a secondary trap;

e) a fan;

f) a water tank; and g) a water supply line;

wherein said bowl has a rim;

wherein said bowl contains a chamber;

wherein said chamber communicates with said rim;

wherein said chamber is for receiving human waste that produces the odious air;

wherein said main trap is contained in said bowl;

wherein said main trap is for communicating said chamber with a waste so as to provide a passageway from said chamber to the waste for the human waste;

wherein said housing is contained in said bowl;

wherein said housing is for communicating said chamber with the waste so as to provide a passageway from said chamber to the waste for the odious air;

wherein said secondary trap is contained in said bowl;

wherein said secondary trap is for communicating said housing with the waste so as to provide a passageway from said housing to the waste for the odious air;

wherein said fan is contained in said housing;

wherein said fan is for activating when a user sits on said bowl, and when activated, moves the odious air from said chamber, through said housing, through said secondary trap, and into the waste;

wherein said water tank fluidly communicates with said bowl;

wherein said water tank is for supplying water to said bowl;

wherein said water supply line is contained in said bowl;

wherein said water supply line fluidly communicates said water tank with said secondary trap; and wherein said water supply line is for allowing said secondary trap to fill with the water.

2. The toilet as defined in claim 1; further comprising a pressure sensitive switch;

wherein said pressure sensitive switch extends operatively upwardly from said rim of said bowl; and wherein said pressure sensitive switch is for being activated when the user sits on said bowl, and when activated, causes said fan to activate.

3. The toilet as defined in claim 2; further comprising a timer;

wherein said timer is contained in said bowl;

wherein said timer electrically communicates with said fan; and wherein said timer allows said fan to operate for a predetermined period of time after said pressure sensitive switch has been released.

4. The toilet as defined in claim 1; further comprising an electric valve;

wherein said electric valve is in electrical communication with said fan;

wherein said electric valve is operatively connected in said water supply line; and wherein said electric valve is for allowing selective flow of the water through said water supply line, and allows the water through said water supply line and into, and fill, said secondary trap only when said fan deactivates.

5. The toilet as defined in claim 4, further comprising a spring biased flap;

wherein said spring biased flap is disposed between said housing and said secondary trap;

wherein said spring biased flap normally closes fluid access to said housing from said secondary trap; and wherein said spring biased flap is for preventing the water filling said secondary trap from backing up into said housing by virtue of only being opened when said fan activates by virtue of being opened by the odious air flowing through said secondary trap and said fan only being activated when said electric valve prevents the water from entering into said secondary trap.

6. The toilet as defined in claim 1; further comprising a gooseneck;

wherein said gooseneck is contained in said bowl;

wherein said gooseneck communicates said chamber with said housing; and wherein said gooseneck is for providing a passageway for the odious air in said chamber to enter said housing.

7. The toilet as defined in claim 6; further comprising a urine shield;

wherein said urine shield extends over said gooseneck and into said chamber; and wherein said urine shield is for preventing urine being deposited in said chamber from entering into said gooseneck.

* * * * *